United States Patent [19]

Hanson et al.

[11] 4,282,658

[45] Aug. 11, 1981

[54] ANTI-BOWING FORM FITTING BOOT

[75] Inventors: Chris A. Hanson, Boulder; George S. Henderson, Nederlands, both of Colo.

[73] Assignee: Hanson Industries Incorporated, Boulder, Colo.

[21] Appl. No.: 123,049

[22] Filed: Feb. 20, 1980

[51] Int. Cl.[3] ..... A43B 5/04

[52] U.S. Cl. ..... 36/121

[58] Field of Search ..... 36/117, 118, 119, 120, 36/121

[56] References Cited

U.S. PATENT DOCUMENTS 3,988,842 11/1976 Rathmell ..... 36/121

FOREIGN PATENT DOCUMENTS 2262453 2/1974 Fed. Rep. of Germany ..... 36/121

*Primary Examiner*—Patrick D. Lawson

*Attorney, Agent, or Firm*—Merriam, Marshall & Bicknell

[57] ABSTRACT

An improved boot for sportswear, such as a custom fitted ski boot with a substantially rigid outer shell, wherein the top instep portion is offset from the lower vamp section. An apertured pleat member interconnects the offset portions. The offset instep-vamp relationship along with the apertured pleat member serves to transmit normally occurring compressive forces through a bending moment at the location of the apertured pleat member to substantially minimize bowing of the boot shell.

9 Claims, 3 Drawing Figures

ANTI-BOWING FORM FITTING BOOT

This invention relates to ankle-covering boots particularly suitable for use in sports footwear, such as custom fitted ski boots, and to improvements therein to prevent undesired "bowing" or "ballooning" of the boot.

BACKGROUND OF THE INVENTION

Reference may be made to the following U.S. patents of interest: U.S. Pat. Nos. 3,738,025; 3,798,799; 3,848,347; 3,882,561; 4,083,127, all assigned to the same assignee as herein; and 3,832,792.

In ankle-covering boots or sports footwear, such as custom fitted ski boots and ice skates, it is desired to have the boot and its components adapted to surround and be contoured to custom-fit the wearer's foot. In such cases, the boot is to provide a support function for the wearer's foot and ankle and enable firm contact to be maintained between the foot and the outer shell of the ski boot.

Reference may be made to the aforementioned U.S. Pat. Nos. 3,798,799 and 3,882,561 wherein the custom fitting operation is disclosed. The aforementioned U.S. Pat. No. 4,083,127 additionally discloses the use of pressure-compensating fitting material used as fitting pads in conjunction with ski boots to maintain a snug or firm fitting relationship with the skier's foot during use to provide protection or comfort by cushion against pressure, impact or shock. Additionally, in view of the required substantially non-compressable stiff plastic material forming the shell of such boots, means may be provided on the boot to achieve adjustment in the normal boot stiffness, such adjustment being shown for instance in U.S. Pat. Nos. 3,738,025, 3,848,347 and 3,832,792.

It has been found however that, in some instances, when substantial pressure is applied to a ski boot as, for example, where a skier impacts the ground level following a jump or the like, the normally stiff boot shell has a tendency to momentarily "bow" or "balloon" in the ankle area. When this occurs, some skiers find this to be an undesirable reduction of support about the foot and ankle area.

It is therefore desired to obviate the "bowing" of the boot shell.

SUMMARY OF THE INVENTION

In accordance with the principles of the invention disclosed and claimed herein, there is provided an improved boot for sportswear, such as a custom fitted ski boot, wherein the top instep boot portion is offset from the lower vamp section. A pleat member having an aperture interconnects the offset top instep boot portion with the vamp section.

The offseting of the top instep portion and the vamp along with the apertured pleat member serves to transmit the normally occurring compressive forces through a bending moment at the apertured pleat member. This substantially eliminates compressive forces in the instep boot area which normally results in the undesired shell bowing.

The aperture located in the pleat member may be filled or sealed with a sealing member which acts as a weather seal, it being understood that the principles of the present invention can be met without the need for the sealing member placed in the aperture.

DETAILED DESCRIPTION

Figure 1:
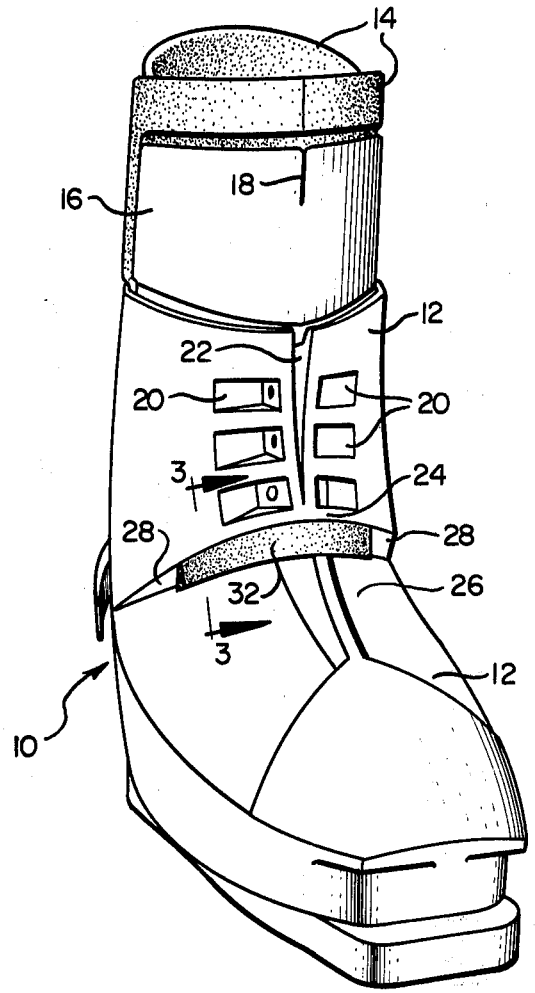
FIG. 1 is a perspective view of a custom fitted ski boot with the top instep portion offset from the vamp section and including an apertured pleat member therebetween.
Figure 2:
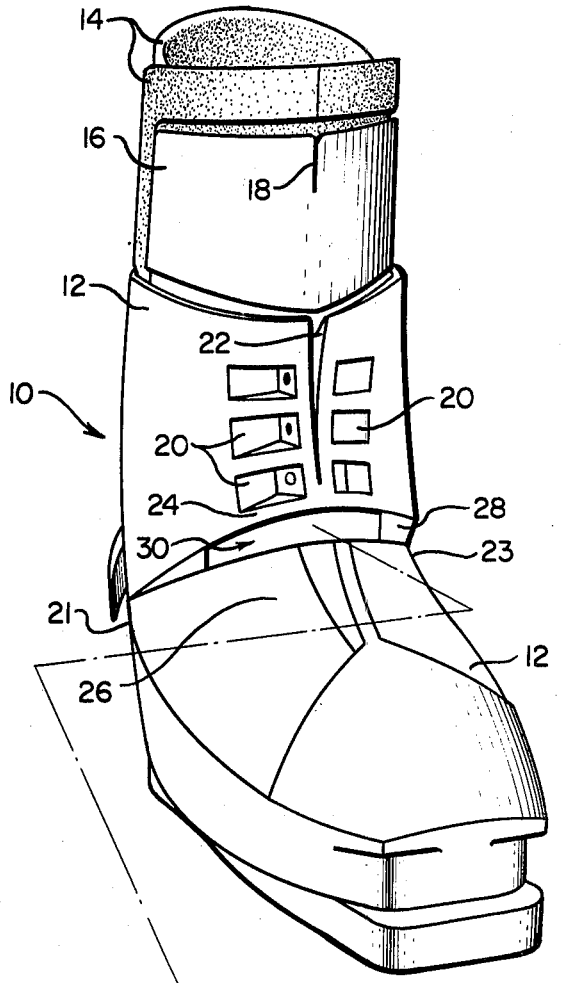
FIG. 2 is a perspective view of the ski boot of FIG. 1 with the weather sealing member removed.
Figure 2:
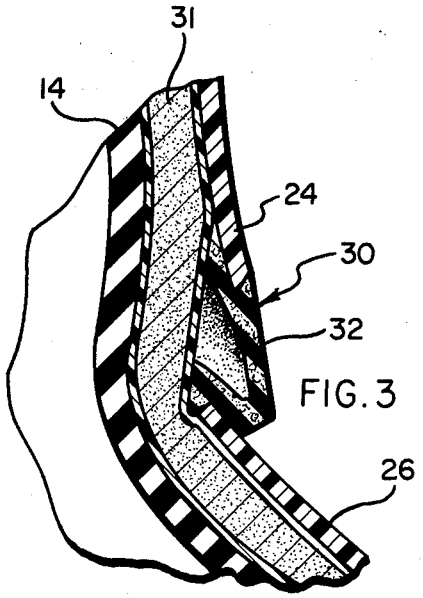

FIGS. 1 and 2 illustrate a custom fitted ski boot 10 disclosed for instance in the aforementioned U.S. Pat. Nos. 3,798,799 and 3,882,561. While the present invention is illustrated and described in connection with a ski boot, it will be appreciated that the invention is not so limited and may be applied to any type of footwear in which bowing is to be prevented from occurring.

The ski boot shown in FIGS. 1 and 2 is of the rear-entry type having a substantially rigid, plastic outer shell 12, and a substantially flexible, inner liner 14 formed for instance of polyurethane foam. A plastic tab 16 with vertically extending slits 18 projects into the boot and provides flexibility to the upper boot portion. At the front of the boot, a plurality of opposed, similarly shaped, aligned pairs of recesses 20 are positioned on opposite sides of a slit 22. Adjustable fastening means such as a threaded screw (not shown) may be positioned in a suitable hole in paired recesses to provide variable stiffness characteristics in the ski boot in the manner disclosed in U.S. Pat. Nos. 3,848,347 and 4,083,127.

As can be seen most clearly with reference to FIG. 2, an upper instep shell portion 24 interconnects with the vamp portion 26 of the boot by means of a pleated wall member 28 having an aperture 30. As noted in FIG. 2, pleat member 28 comprises a thin, wall section on either side of the aperture 30, with each of the pleat member wall sections interconnecting a respective portion of the top instep with the lower vamp and defining aperture 30 therebetween. In addition, aperture 30 in pleat member 28 extends transversely across the front centerline of the boot to substantially eliminate, in the aperture area, any direct shell wall connection between the top instep portion 24 and the lower vamp 26. The aperture 30 is slightly off-center, i.e., the aperture extends slightly longer to the one side 21 of the boot center line than the remaining side 23 as viewed in FIGS. 1 and 2. This provides more of an open area in the pleat member on the outer boot portion as opposed to the inner boot portion.

Figure 3:
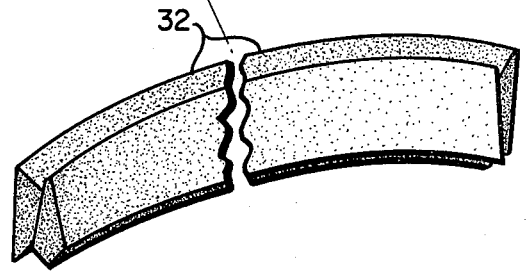
FIG. 3 is a fragmented sectional view taken along section lines 3—3 of FIG. 1 illustrating the instep portion overlying a portion of the vamp, and the weather sealing member in position closing the pleat member aperture.

Furthermore, as shown in the fragmented sectional view of FIG. 3, the upper end of vamp 26 and the lower end of the top instep portion 24 are not aligned across the front of the boot. The lower end of instep portion 24 overlies a portion of the vamp. Thus, there is an offset relationship between the top instep 24 and vamp 26 so that when a substantial downward and forward force is placed on the boot, this places the shell into a bending moment rather than a compression in the apertured area, thereby preventing the undesired bowing of the shell material in the ankle area on either side of the boot.

It will be appreciated that the size of aperture 30 should be kept as small as possible in order to avoid any lessening in the strength or integrity of boot 10. It has been found that an aperture 30 with an area roughly about fifty percent of the total pleat member area is preferred to operate in accordance with the invention, it being understood that a range in aperture area of about twenty five percent to about seventy five percent of the total pleat member area is suitable.

Without the instep - vamp offset, the size of aperture 30 would have to be significantly increased from that shown in FIG. 2, and yet the shell material would still transmit compressive forces towards the boot ankle portion tending to cause undesired bowing. With the offset as provided in accordance with the present invention, the size of aperture 30 can be made significantly smaller, thereby maintaining boot structural integrity. Forces, acting on the boot, as for example, when a skier strikes the ground following a jump or the like, are transmitted through the boot so as to provide a bending moment at the location of the apertured pleat. Because of the apertured pleat, bowing of the boot shell is minimized.

In the sectional view of FIG. 3, a pack 31 of resilient material extends within the boot and behind the top instep portion 24 and lower vamp 26 across aperture 30. It is to be understood that the aperture 30 can be left open to achieve the principles of the present invention. However, it may be desired to insert a resilient weather sealing member to cover aperture 30 and thereby seal the opening from the environment. As an example, a resilient weather seal member 32 incorporating suitable grooves as shown in FIG. 3 may be inserted from within the boot 10 to seal aperture 30 and prevent moisture from entering the boot through aperture 30. The weather seal member 32 can be formed of the same material as liner 14, i.e., a polyurethane foam. If desired, the shell material could be extended to provide a thin shell cover extending over the aperture to serve as a weather seal.

While particular embodiments of the present invention have been shown and described, it will be obvious to those skilled in the art that various changes and modifications may be made without departing from the invention in its broader aspects. Accordingly, the aim of the appended claims is to cover all such changes and modifications as may fall within the true spirit and scope of the invention.

What is claimed is:

1. In a boot that covers the ankle of the wearer, said boot including a vamp and an upper instep portion, an improvement for preventing bowing of the boot on either boot side adjacent the wearer's ankles, said improvement comprising:

said upper instep portion extending downwardly to overlie a portion of said vamp;

a pleat member interconnecting said upper instep portion and said ramp portion; and said pleat member including an aperture extending transversely across the front of said boot and between said upper instep portion and said vamp portion.

2. The improvement of claim 1, wherein said aperture is slightly off-center with respect to the boot centerline.

3. The improvement of claim 1, including a weather sealing member inserted in said aperture for sealing said aperture from the environment.

4. The improvement of claim 3, wherein said weather sealing member comprises a resilient, foam pad.

5. The improvement of claim 1, wherein said pleat member includes a thin wall contiguous with said upper instep portion and said vamp portion.

6. The improvement of claim 5, wherein said pleat member includes said thin wall on respective transverse ends of said aperture.

7. The improvement of claim 5, wherein said aperture is defined by said upper instep portion and said vamp portion, and by a respective thin wall contiguous with said upper instep portion and said vamp portion at transverse ends of said aperture.

8. The improvement of claim 1, wherein the ratio of aperture area to the total pleat member area is about 25–75%.

9. The improvement of claim 1, wherein the ratio of aperture area to the total pleat member area is about 50%.

* * * * *

UNITED STATES PATENT AND TRADEMARK OFFICE

CERTIFICATE OF CORRECTION

PATENT NO. : 4,282,658

DATED : August 11, 1981

INVENTOR(S) : Chris A. Hanson and George S. Henderson

It is certified that error appears in the above—identified patent and that said Letters Patent is hereby corrected as shown below:

Column 4, line 12, "ramp" should read -- vamp --.

Signed and Sealed this

*Thirteenth* Day of *October 1981*

[SEAL]

*Attest:*

GERALD J. MOSSINGHOFF

*Attesting Officer*

*Commissioner of Patents and Trademarks*